US005775578A

United States Patent [19]

Baxi et al.

[11] Patent Number: 5,775,578

[45] Date of Patent: Jul. 7, 1998

[54] MAILBOX SLIDABLE HOODED TRAY INSERT

[76] Inventors: Rupen P. Baxi, 45112 Kensington Rd., Utica, Mich. 48317; Peter J. Backer, 1287 Johns Rd., Clinton, Ohio 44216

[21] Appl. No.: 715,863

[22] Filed: Sep. 19, 1996

[51] Int. Cl.[6] ..... B65D 91/00

[52] U.S. Cl. ..... 232/17

[58] Field of Search ..... 232/112, 17, 27, 232/28, 29, 30, 38

[56] References Cited

U.S. PATENT DOCUMENTS

| | | | |
|---|---|---|---|
| 1,839,834 | 1/1932 | Coleman | 232/28 |
| 4,600,143 | 7/1986 | Harlow et al. | 232/17 |
| 4,753,385 | 6/1988 | Phipps et al. | 232/30 X |
| 5,009,366 | 4/1991 | Van Duff et al. | 232/17 |
| 5,271,555 | 12/1993 | Mayer | 232/19 X |
| 5,425,501 | 6/1995 | Wesorick | 232/17 |

*Primary Examiner*—Jerry Redman
*Attorney, Agent, or Firm*—James H. Bower

[57] ABSTRACT

A rural mailbox hooded retractable tray insert molded from a plastic material having flexural ability. The mailbox hooded tray insert having a finger grip for in and out movement of the tray and a slider groove along the hood length that guides and limits the in and out movement. The tray insert hood prevents mail from falling out during tray movement and contains storage space for bee and insect repellant. The tray insert back wall has a vertical member having a flexible hinge for moving the tray insert partially out of the mailbox to expose the finger grip when the mailbox is opened.

4 Claims, 2 Drawing Sheets

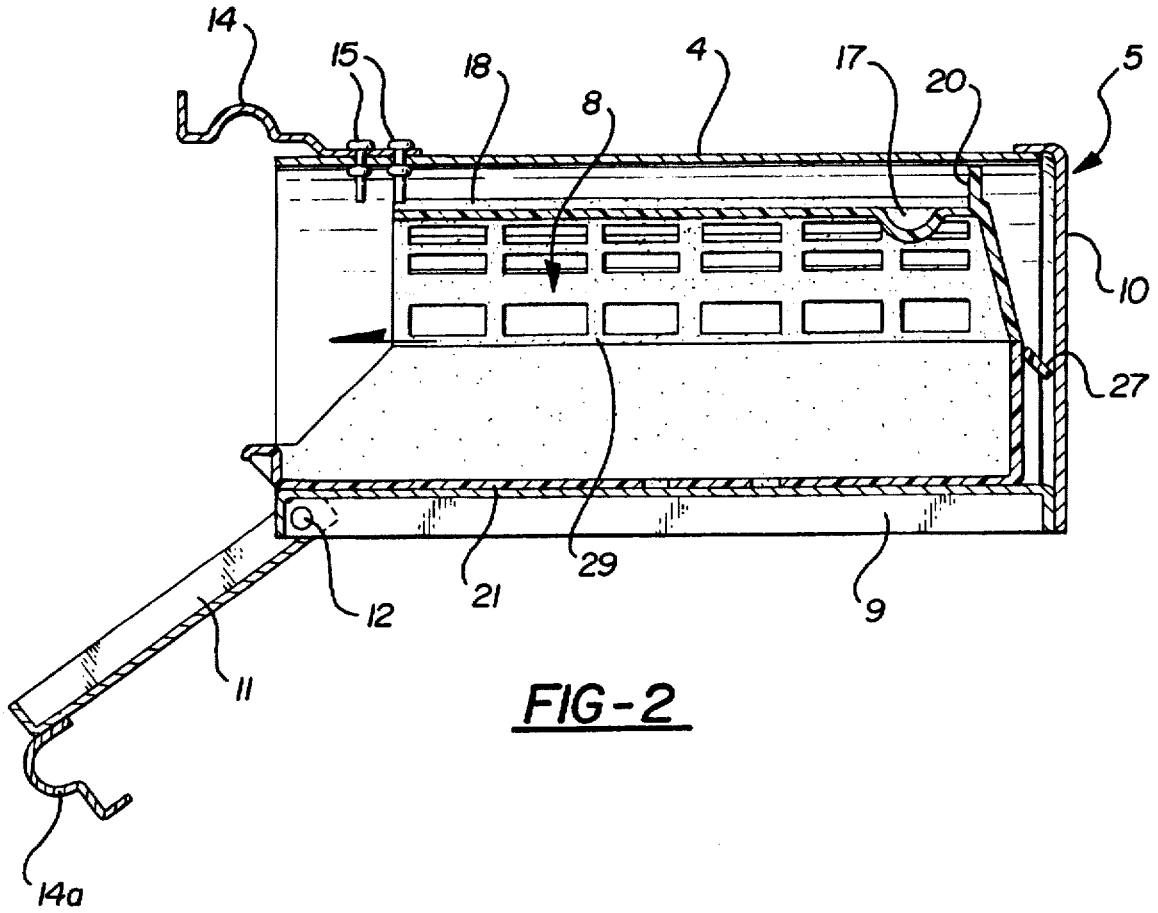
FIG-2
FIG-3
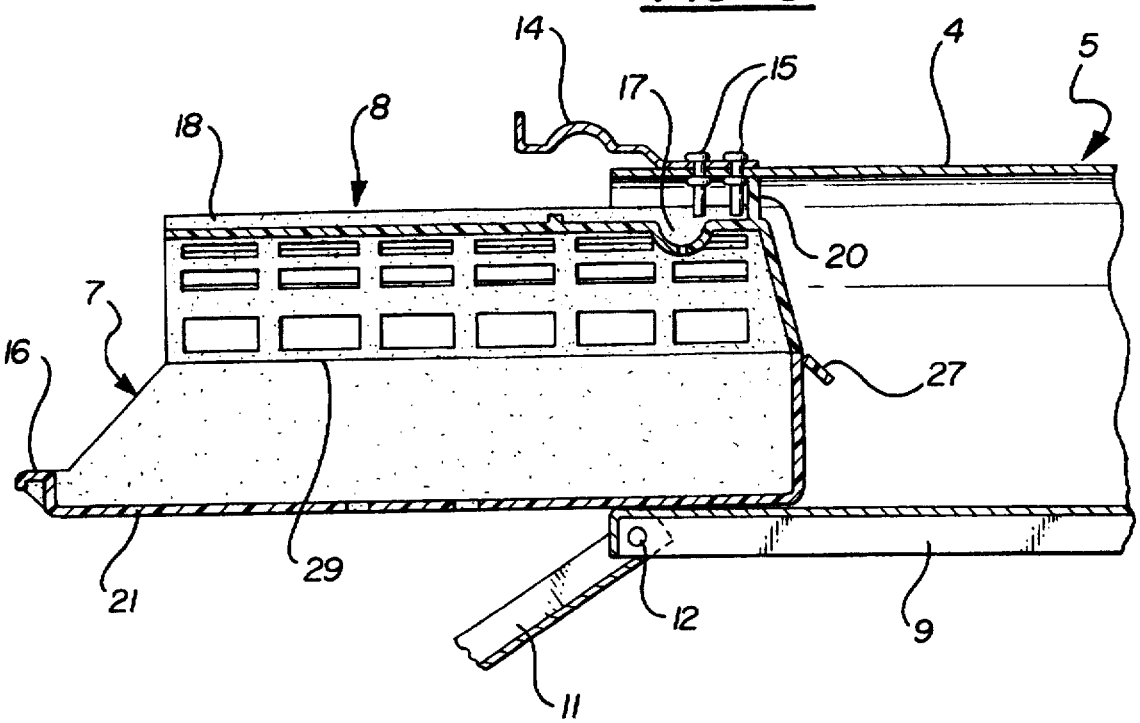

MAILBOX SLIDABLE HOODED TRAY INSERT

BACKGROUND OF THE INVENTION

The present invention relates to a mailbox used on rural U.S. mail delivery routes, and more particularly to a rural type mailbox having a tray that is slidable within said mailbox to assist the gathering of mail.

Conventional United States Postal Service approved mailboxes with a top latched attached door have been used for many years on rural mail delivery routes. In delivering the mail, the postal service employee normally opens the door latch of the mailbox and deposits the mail therein. The owner of the mailbox must then open the door and extend his/her arm to search the entire enclosure of the mailbox for the deposited mail normally by visual inspection to retrieve the mail.

After dark, visual inspection is nearly impossible to remove the contents requiring searching in an attempt to locate and retrieve the mail. Additionally, in attempting to retrieve the mail, the person often times is within the automobile and is required struggling to extend arm or required leaving the motor vehicle to reach the mail.

The present invention is designed to overcome the above-noted limitations and toward this end, it contemplates the provision of a novel hooded tray insert seated within the enclosure of the conventional mailbox thereby providing easy accessibility to the deposited mail.

It is an object of the invention to provide a hooded tray insert which can be provided as an accessory for existing mailbox installations, or new mailboxes.

Another object is to provide such a device to eliminate searching and stretching for deposited mail located within the enclosure of the mailbox.

A further object is to provide a mailbox tray insert having a top hood to prevent loss of mail.

Another object is to provide storage area for a moth ball or other insert repellent to keep bees or other insects out of a mailbox.

A further object is to provide such a device which may be economically molded from plastic flexible material and will not rust and provide long life.

SUMMARY OF THE INVENTION

The rural mailbox has a generally rectangular bottom panel, a back panel, and an inverted U-shaped top portion defining an enclosure with an entrance opening at one end, having a door pivoted from the bottom section, providing opening and closing movement for the door to permit deposit and removal of U.S. mail and other packages.

The inverted U-shaped mailbox top having a roof latch attached with two machine screws or bolts projecting through the roof wall. The latch is to secure the pivoted door in the closed position.

The latch projecting screws are used in guiding the hooded tray for longitudinal movement within the mailbox. The novel hooded tray is seated within the mailbox enclosure for in and out movement through the entrance opening which is located on the mailbox front.

The novel tray incorporates a hood top cover to prevent loss of mail and means to move the tray in and out of the mailbox enclosure to easily obtain the mail. Also means to deter insects from entering the mailbox and means for smooth movement and maintaining the tray in a horizontal position.

BRIEF DESCRIPTION OF THE DRAWINGS

FIG. 2 is a side elevation cross sectional view of a mailbox with its door in open position and the internally enclosed hooded tray.

FIG. 3 is a fragmentary side elevation cross sectional view of the mailbox to show the hooded tray insert in its extended position.

DETAILED DESCRIPTION OF THE PREFERRED EMBODIMENT

Figure 1:
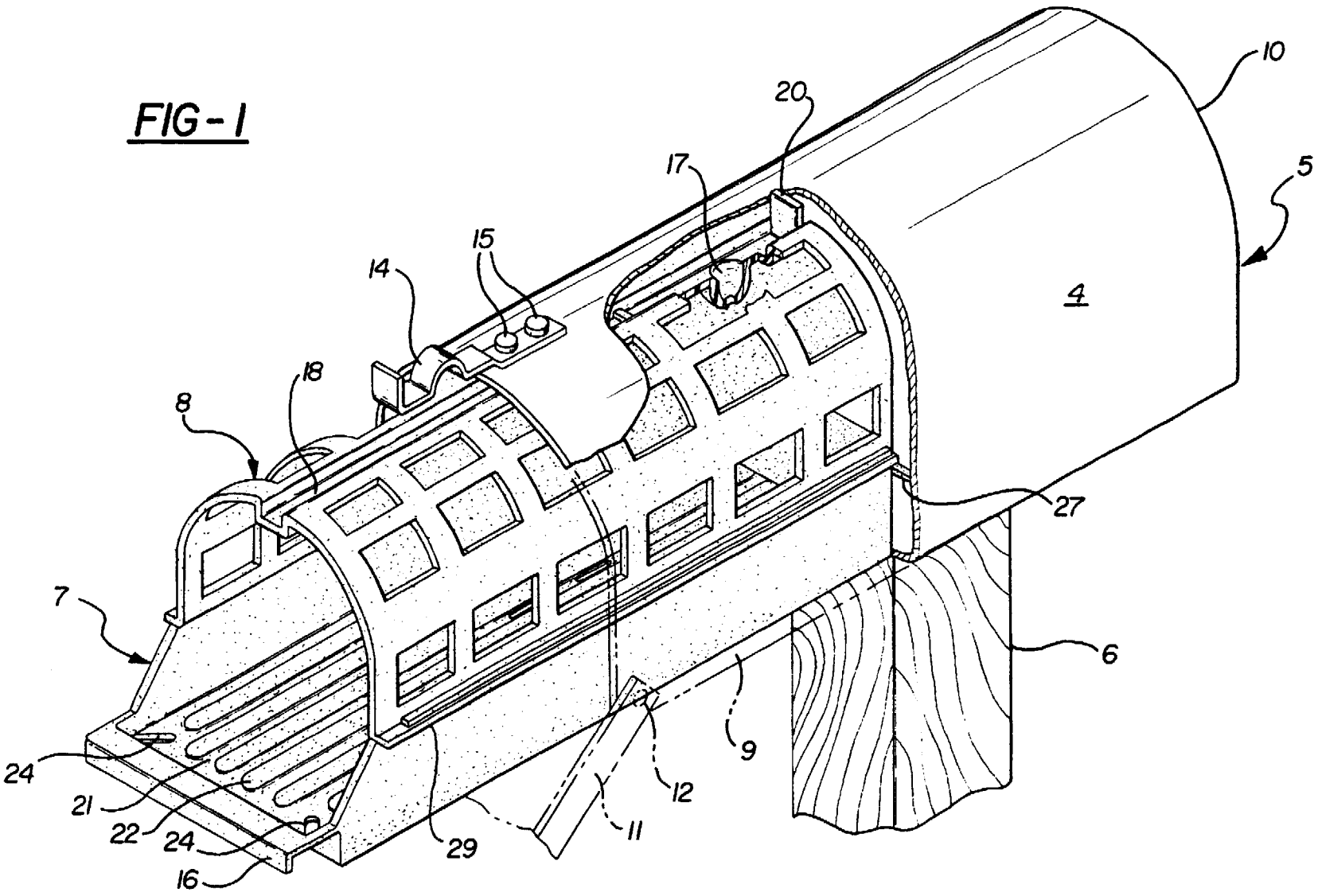
FIG. 1 is a perspective view illustrating a mailbox and a hooded retractable tray insert embodying the present invention with a portion of the mailbox broken away.

Referring to the drawings, FIG. 1 illustrates a conventional rural type mailbox 5 mounted on a vertical pole 6, having a hooded tray insert generally indicated as 7, the lower half, and 8 the inverted U-shaped upper hooded half, each half joined at 29 to form a completed hooded tray insert 7 and 8. The preferred method of joining the rectangular tray insert 7 lower half with the inverted U-shaped hooded upper half 8 at 29 in by means of a tong and grove mechanism having a snap action to firmly hold the two halves 7 and 8 together.

The mailbox 5 has a rectangular bottom 9 and inverted U-shaped top 4 and a front door 11 having hinge 12. The roof latch 14 for door 11 is located on inverted U-shaped roof 4 and is fastened with two machine screws 15 which extend through the thickness of the mailbox roof as shown in FIGS. 2 and 3 at machine screw 15. The door mating latch, 14(*a*), contacts roof latch 14 when the mailbox door 11 is closed and latches door 11 closed.

The hooded tray insert 7 and 8 is made in two halves of thermoplastic material and snapped together at 29 to form one unit. FIG. 1 shows the lower half 7 fastened together with hooded top 8 at snap fit mechanism joint 29.

The hooded upper half 8 contains open groove 18 running the length of hood 8 top as shown in FIG. 1, to vertical finger 20. The function of groove 18 is to guide the tray insert 7 and 8 during longitudinal movement within mailbox closure 5 by means of machine screws 15 protruding into groove 18. Vertical finger 20 at the rear of groove 18, is extending upward from groove 18, to contact machine screws 15 stopping longitudinal movement when the insert 7 and 8 is in its extended position as shown in FIG. 3. In this extended position, finger 20 also contacts the inside surface of mailbox 4 roof preventing the tray insert from tipping forward.

Also in groove 18 is provided a round storage space 17 for a moth ball or other insect repellant to keep bees or insects out of the mail storage area.

The tray insert 7 and 8 of the present invention is dimensional sized to slide within the mailbox enclosure 5 and through the entrance opening when front door 11 is open. The tray bottom wall 21 is provided with a series of parallel ribs 22 to prevent mail from adhering to the bottom wall as a result of rain or snow entering mailbox 5. The tray bottom wall 21 also has drainage apertures 24 to prevent water building thereon.

Also attached to bottom 21 is finger grip 16 which is used to retrieve mail from the tray insert by pulling the grip 16 and tray partly through the open mailbox door 11 opening until vertical finger 20 contacts machine bolt 15 as shown in FIG. 3. Finger 20 stops further withdrawal of the insert tray and maintains the tray in a horizontal position by finger 20 contacting the mailbox roof 4, while in the extended position (FIG. 3).

To reinsert the tray insert 7 and 8 within the mailbox closure 5, finger grip 16 is pushed back toward mailbox closure 5 rear wall 10 until live hinge member 27 is in the vertical position against rear wall 10. The purpose of live hinge member 27 is to provide spring action between the rear wall of the mailbox 5 and the rear wall of tray insert 7 and 8 to allow the tray insert to spring forward when the mailbox 5 door 11 is opened. This will assist grasping finger grip 16 to slide the tray insert forward. The door closure 11 is then pivoted shut at 12 and latch 14 and 14(*a*) make contact.

The tray insert is preferably a two piece unit molded from a plastic resin such as high density polyethylene, but it is apparent that it may be manufactured as one piece from other suitable materials which exhibit qualities and desired resiliency to permit flexing movement and weather resistant qualities.

It is apparent that vertical finger 20 at the rear of groove 18 may be removed to permit complete removal of tray insert 7 and 8 from mailbox 5. Also it is apparent that mailbox 5 may incorporate a back door for mail retrieval and tray insert 7 and 8 may be slid backward through such back door for mail retrieval.

What is claimed is:

1. A slidable hooded tray insert in combination with a rural mailbox having a bottom panel, a back panel and a U-shaped roof portion defining an enclosure with an entrance opening at one end thereof, and a door member having a door latch, and a roof latch attached to the U-shaped roof to make contact with said door latch, the door member pivotally mounted adjacent said entrance opening for movement between an open position permitting access to the enclosure through the entrance opening and a closed position covering the entrance opening, said slidable hooded tray insert comprising: a rectangular bottom wall section, an inverted U-shaped hood top piece extending downwardly attached to said bottom wall section, a first end wall extending upwardly from said bottom wall and transversely between said inverted U-shaped hood top piece and a second end wall extending upwardly from said bottom wall opposite said first end wall, and having a finger grip disposed on said second end wall, said finger grip normally forms inverted C-shape to said bottom wall, the inverted U-shaped hood top piece contains a groove for guiding the hooded tray insert smoothly in horizontal engagement in and out of said rural mailbox.

2. The hooded tray insert of claim 1 wherein said groove contains a storage space for insect repellant to keep bees or insects out of the enclosure.

3. The hooded tray insert of claim 1 wherein said groove contains a vertical finger at one end to limit longitudinal movement within said rural mailbox.

4. The hooded tray insert of claim 3, wherein said longitudinal movement is stopped by roof latch machine screws contacting said vertical finger.

* * * * *